United States Patent [19]

Crawford

[11] Patent Number: 4,793,439

[45] Date of Patent: Dec. 27, 1988

[54] APPARATUS FOR CLIMBING TREES, POLES AND THE LIKE AND BEING REMOTELY CONTROLLED FROM GROUND ELEVATION

[76] Inventor: Homer S. Crawford, 4418 Shingle Oak La., Houston, Tex. 77008

[21] Appl. No.: 142,181

[22] Filed: Jan. 11, 1988

Related U.S. Application Data

[63] Continuation-in-part of Ser. No. 078,903, Jul. 28, 1987, abandoned.

[51] Int. Cl.[4] ..... B66F 1/02; B66F 19/00

[52] U.S. Cl. ..... 182/136; 182/187

[58] Field of Search ..... 182/187, 188, 133, 136; 187/9 R

[56] References Cited

U.S. PATENT DOCUMENTS

| | | | |
|---|---|---|---|
| 3,237,720 | 3/1966 | Landqvist | 182/133 |
| 3,504,767 | 4/1970 | Sherman | 182/187 |
| 3,520,383 | 7/1970 | Loock | 182/133 |
| 3,870,123 | 3/1975 | Izumi | 182/187 |
| 4,060,149 | 12/1977 | Henley | 182/133 |
| 4,637,494 | 11/1984 | Iida et al. | 182/136 |
| 4,677,936 | 5/1986 | Dahlem | 182/136 |

*Primary Examiner*—Reinaldo P. Machado
*Attorney, Agent, or Firm*—Gunn, Lee & Jackson

[57] ABSTRACT

Apparatus for climbing trees, poles and other like objects includes a main frame having a hydraulically driven telescoping mast disposed in telescoping relation therewith. Upper and lower hydraulically energized gripping apparatus is provided respectively on said hydraulically driven telescoping mast and main frame and include gripping arms for establishing gripping relation with said object. The apparatus includes power and control circuitry for inducing telescoping movement to the hydraulically driven telescoping mast, actuation of the upper and lower gripping apparatus and for operating various winches that enable the apparatus to lift objects relative to the apparatus. The upper and lower gripping apparatus incorporates pressure energized safety lock-out apparatus that insures that at least one of the upper or lower gripping apparatus remains in gripping relation with the object to prevent falling of the apparatus. A manual override system, actuatable only at ground level is provided to permit simultaneous opening of the upper and lower gripping apparatus when the tree climbing apparatus is assembled to or removed from the tree or pole.

19 Claims, 3 Drawing Sheets

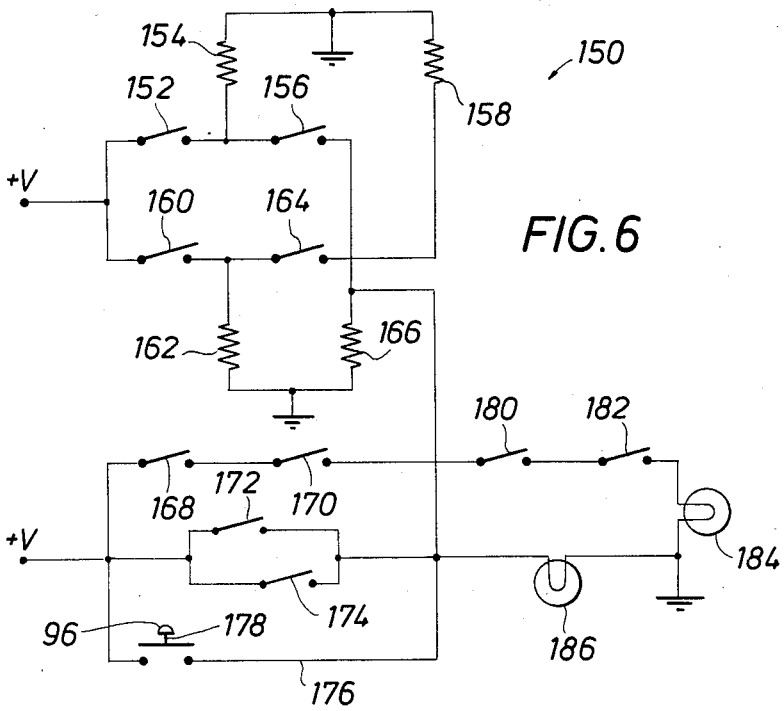
FIG. 6
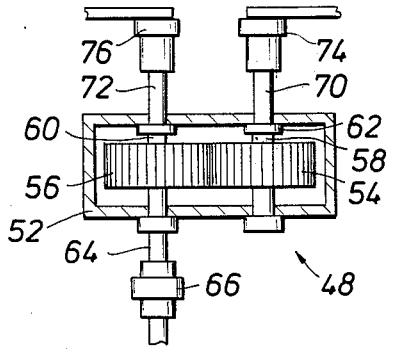
FIG. 5
FIG. 7
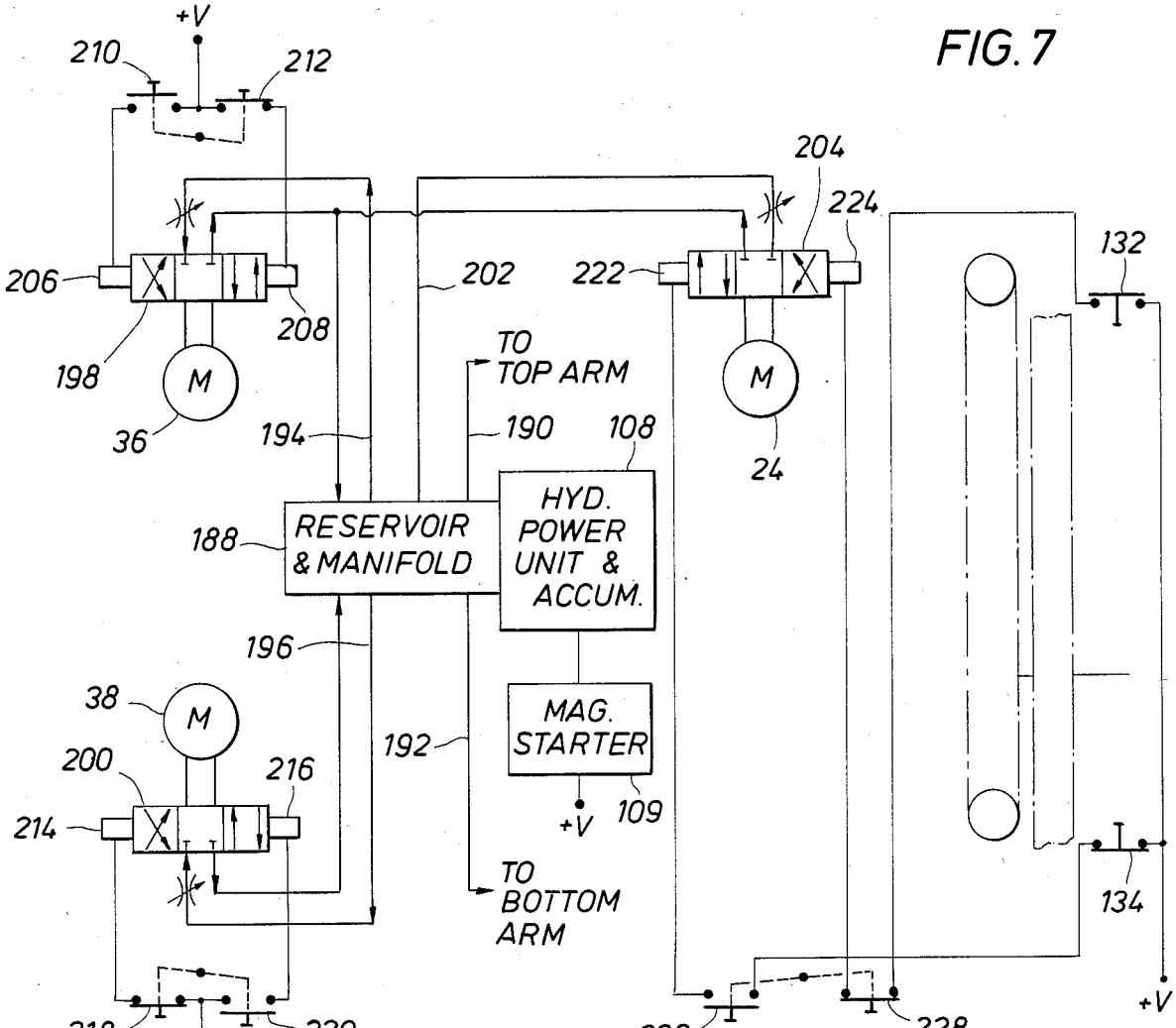

APPARATUS FOR CLIMBING TREES, POLES AND THE LIKE AND BEING REMOTELY CONTROLLED FROM GROUND ELEVATION

This is a continuation-in-part of now abandoned U.S. patent application Ser. No. 078,903 filed on July 28, 1987 by Homer S. Crawford and entitled "APPARATUS FOR CLIMBING TREES OR POLE-LIKE OBJECTS, REMOTELY CONTROLLED FROM A GROUND ELEVATION".

FIELD OF THE INVENTION

This invention relates generally to the art of tree surgery and has application in fields where trees, poles and the like for conducting various activities above ground level. More specifically, the invention concerns apparatus that is capable of climbing a tree, a pole or other such structure while being controlled by personnel at ground elevation. The term "climbing" as employed herein is intended to include various modes of travel including vertically upward and downward, horizontal and lateral since the apparatus may be employed in environments other than tree surgery.

BACKGROUND OF THE INVENTION

In the field of tree surgery, it is frequently necessary for personnel to gain elevation to specific portions of trees for the purpose of removing branches or large limbs from the trees or in many cases removing a tree in such manner that its parts do not fall and damage adjacent structures such as buildings and objects at ground level. The method presently employed to remove limbs, branches, or to cut down the entire tree is for an operator to gain access to a working elevation in a tree by manually climbing the tree with the use of hand lines, and/or climbing spurs. In some cases, a hand line is used alone to assist the operator in gaining elevation in the tree once the hand line has been placed over a limb by any suitable method from ground elevation. In many cases tree surgery operations may be conducted in such manner that small limbs, branches may be allowed to fall to the ground after having been cut away from the tree. In other cases, however, shrubs and other plants may be located at ground level which would be damaged by falling branches. It is then necessary for operators to tie ropes to the branches prior to cutting and then manually lower the branches to ground level with the assistance of ground level personnel. This character of work is time consuming, strenuous and dangerous.

Another method of conducting tree surgery operations and the like requires the use of a suitable life device such as a mobile mounted mechanical extension arm and bucket which is capable of transporting tools and other equipment to a working elevation in a tree or relative to a pole. By the use of a mobile mounted mechanical extension arm and bucket tools and equipment can be easily transported to working elevations, however, most mechanical lift devices of this type have a limit as to the elevational height that can be gained. Further, there must be sufficient area around the tree or pole to allow the mobile life unit to be located in a satisfactory position for conducting lifting and positioning. In many cases the mobile mounted mechanical extension arm devices are supported on trucks. It may not be possible to gain access to the location of the tree or pole by a truck without causing significant surface damage, which, of course, is undesirable.

Tree surgeons and other such workers may also employ ladders to gain access to certain elevators in tree, poles, etc. Typically, ladders have height limitations and are somewhat dangerous to use.

It is seen, therefore, that there are certain disadvantages and limitations to all of the above methods for positioning equipment at working elevations in trees and relative to other structures. There is a significant possibility that personnel could fall such as when using climbing spurs, ladders, etc. When hand lines are employed the line could slip or break and a limb could break, possibly resulting in falling on personnel or damage to objects at the surface or adjacent to the tree or pole. These and a number of factors associated with various activities elevation in trees and poles can present a considerable safety hazard. Another disadvantage when work is performed at elevation in trees, on poles and other structures is the amount of time that is required to position tools and equipment at the desired elevation in comparison to the time required for personnel to perform certain types of work such as tree surgery, for example.

It is desirable, therefore, to provide apparatus that is capable of safely and efficiently climbing trees, poles and other such objects under the control of personnel remaining at ground level and, after the apparatus is securely stationed at elevation, providing motive power for positioning tools and equipment at working elevation and then conducting mechanical operations such as lowering cut tree parts and the like safely to ground level for handling by personnel at ground level. It is also desirable to provide tree or pole climbing apparatus which is capable of fastening itself securely to the tree or pole and which is not capable of becoming inadvertently deenergized and thus is absolutely prevented from completely releasing its assembly from the tree or pole until the apparatus reaches ground level.

Trees generally have a more or less straight trunk which extends from ground level to the elevation of lower limbs and then have limbs extending randomly and radially from upper portions of the tree trunk. It is desirable to provide tree climbing apparatus having the capability of traversing vertically up and down the tree as appropriate and also having the capability of traversing laterally around the tree such as for avoiding limbs that might impede vertical traversing. It is also desirable to provide the apparatus with other features to enable it to remotely conduct various desirable operations. These features may be in the form of attachments for various operations such as tree spraying, limb cutting and pruning. It is also considered appropriate to provide tree climbing apparatus that may be effectively controlled by personnel located at ground level and may also be controlled by personnel located at the working level of the apparatus.

SUMMARY OF THE INVENTION

A principal feature of the present invention is the provision of novel climbing apparatus for trees, poles and other structures which is provided with a remote operating control connected to the apparatus by a long control cable or by radio telemetry and can function at the command of operating personnel located either at ground level or at the working level of the apparatus.

It is also a feature of this invention to provide a novel climbing apparatus that is capable of vertical climbing for assent to and descent from trees, poles and the like and which is also capable of traversing laterally around the tree or pole.

It is another feature of this invention to provide novel climbing apparatus incorporating electrical and hydraulic systems for operation and utilizing a hydraulic system for securing the apparatus to a tree or pole by means of a hydraulically controlled gripping system that can not be completely deenergized with the apparatus located above ground level.

It is another feature of this invention to provide novel climbing apparatus that can be efficiently stabilized as a working platform at a desired elevation to thus provide a stable working location for operating personnel at the working elevation of the apparatus.

It is an even further feature of this invention to provide novel climbing apparatus incorporating a winch and cable system controlled by operating personnel either at ground level or at the working level of the apparatus or both and which can be efficiently controlled for handling objects at the working level and for lowering limbs and other apparatus from the working level to ground level as desired.

It is also an important feature of this invention to provide novel climbing apparatus having incorporated therein at least one manually extendable mast that can be employed as a crane to lower limbs, tree trunk sections and other apparatus to ground level by means of a winch and cable system.

It is an even further feature of this invention to provide novel climbing apparatus that provides dual winch lines which can be remotely controlled by the operator to aid in the transfer of limbs, tree trunk sections and the like to ground elevation as they are cut from the tree.

It is another feature of this invention to provide novel climbing apparatus that enables the operator to safely and efficiently remove long sections of tree trunk such as when a tree is being removed and to lower the same safely and efficiently to ground level for handling by personnel at ground level.

It is also a feature of this invention to provide novel climbing apparatus that enables effective operations such as tree and pole climbing, tree surgery and other service work to be performed efficiently and safely.

Briefly stated, this invention concerns climbing apparatus for trees, poles and the like which also serves as a working platform for operating personnel located at the elevation of the apparatus and is also capable of performing other specific tasks as selected and controlled by operating personnel. The apparatus consists of a main frame structure having at least one pair of operating arms for at least partially encircling the tree or pole to secure the main frame thereto. The apparatus further incorporates a hydraulically driven telescoping mast that is telescopically related to the main frame and which is operated by a hydraulic motor, cable and sheave assembly for elevating and retracting the hydraulically driven telescoping mast. The hydraulically driven telescoping mast is also provided with at least one pair of hydraulically energized gripping arms that are separately and independently actuatable as compared to the gripping arms of the main frame. The gripping arms of the main frame and hydraulically driven telescoping mast are sequentially activated to cause the apparatus to "climb" a tree, pole or other structure. The gripping arms are also movable to a fully retracted position which enables the apparatus to pass between limbs and thus climb above the level of the limbs. The apparatus incorporates a control system that insures that either the upper or lower set of gripping arms will continuously and positively grip the tree, pole or other structure to secure the apparatus against falling. The control circuitry of the apparatus includes an override switch that permits simultaneous opening of the upper and lower gripping arms only when the apparatus is located at ground level. A signal is given by a set of series switches of the upper and lower arm gear boxes that close when both gripping arms are fully secured around the tree trunk, pole or other object.

After the apparatus has reached an appropriate working level, both sets of gripping arms are energized to thereby insure that the apparatus is positively and securely retained before it is employed to hoist tools and equipment to the working level of the apparatus. Moreover, the apparatus is further provided with one or more safety belts that are securely fastened after the apparatus has become secured at the working level to thus provide further assurance that the apparatus will be secured against falling even when subjected to heavy loads such as tree trunk sections, tools, supplemental equipment, etc.

The apparatus employs an electrical control system normally having a control cable of sufficient length that the apparatus may be controlled from various remote locations such as ground level or at an elevated level above, below or laterally from the apparatus.

The apparatus also incorporates a pair of uppermost, manually operable masts having cable sheaves at the upper end of the uppermost mast. These manually operable telescoping masts may be employed to secure a long section of tree tunk and then lower the section of tree trunk to ground level after the section is cut from the tree. This feature minimizes the number of cuts that must be made by tree surgeons to remove tall trees and to safely lower the trunk sections to ground level without damaging shrubs and other surface cover at ground level or buildings and other structures that may be located adjacent the tree. Obviously, tall poles may be sectioned and removed in like manner.

The apparatus also has the capability of traversing or walking around the tree trunk or pole such as to avoid limbs and other structures that might otherwise impede vertical traversing of the apparatus during climbing and descending. The tree climbing apparatus is further adapted to incorporate various other supplemental features such as tree spraying apparatus, limb cutting and pruning apparatus without departing from the spirit and scope of this invention.

BRIEF DESCRIPTION OF THE DRAWINGS

So that the manner in which the above recited features, advantages and objects of this invention as well as others which will become apparent are attained and can be understood in detail, a more particular description of the invention, briefly summarized above, may be had by reference to the embodiments thereof that are illustrated in the appended drawings, which drawings form a part of this specification.

It is to be noted, however, that the appended drawings illustrate only typical embodiments of this invention and are therefore not to be considered limiting of its scope, for the invention may admit to other equally effective embodiments.

In the Drawings:

Figure 1:
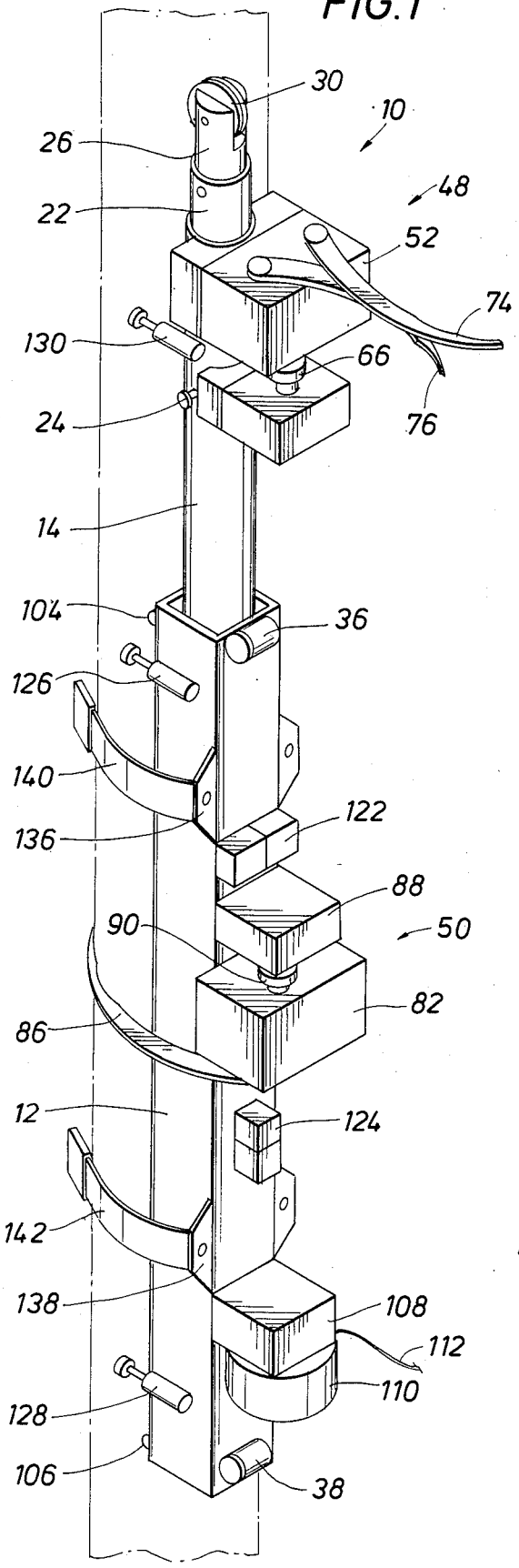
Figure 2:
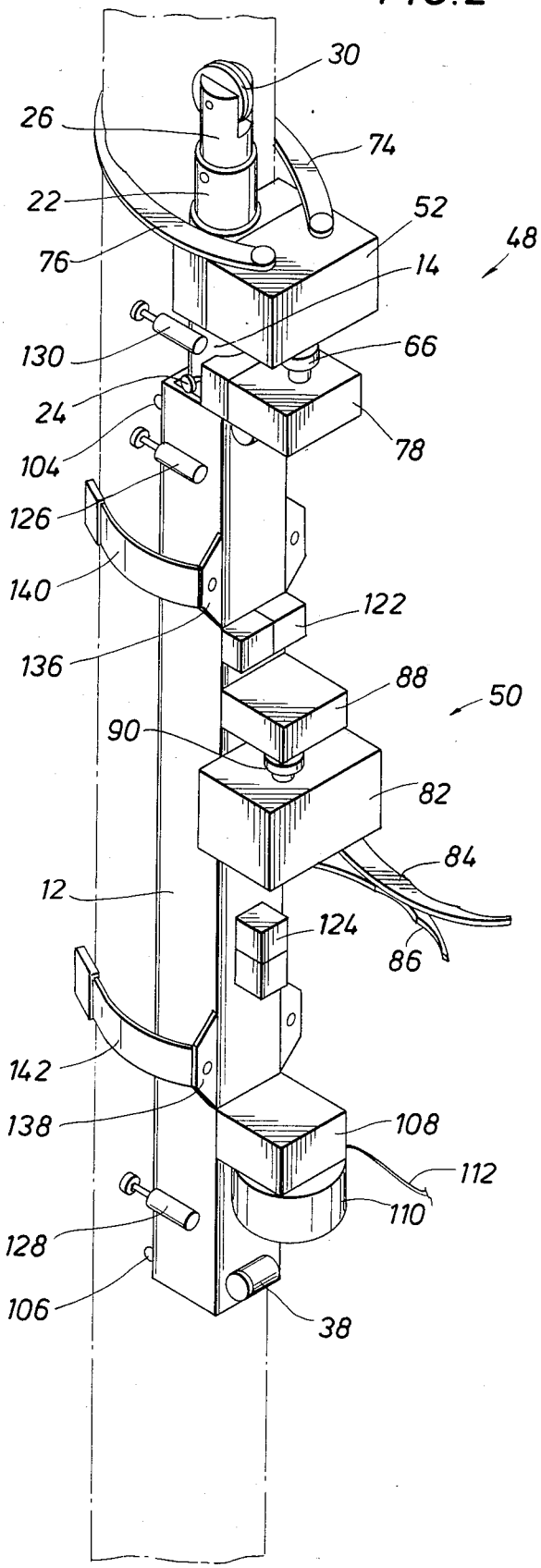
Figure 3:
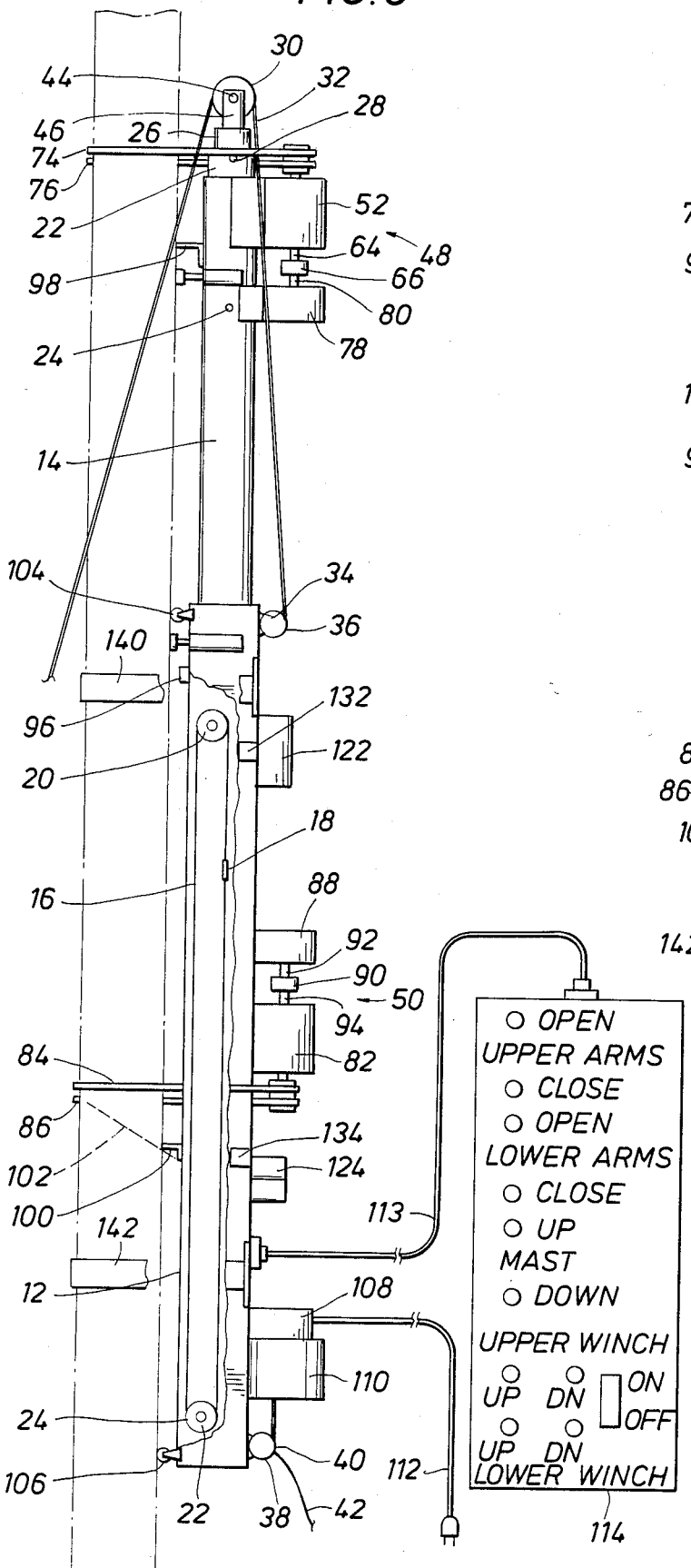
Figure 4:
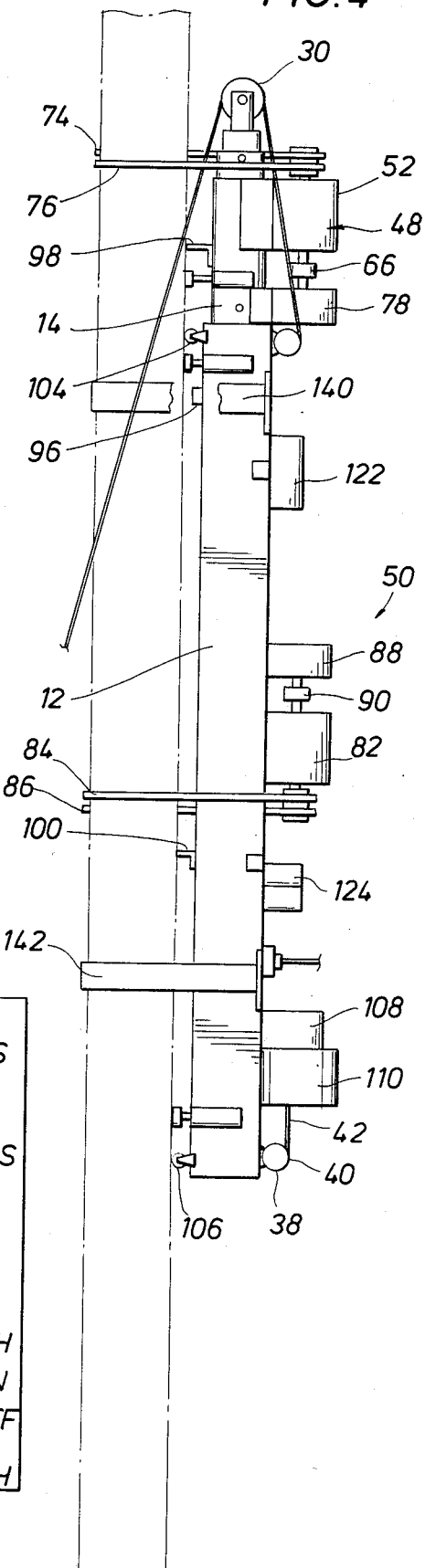

FIG. 1 is an isometric illustration of tree climbing apparatus constructed in accordance with the present invention and being shown with the lower gripping arms thereof secured to a tree or pole shown in broken lines and with the upper gripping arms being retracted from gripping position such as during upward or downward traverse of the hydraulically driven telescoping mast or climbing or descending;

FIG. 2 is an isometric illustration similar to that of FIG. 1 showing the upper gripping arms of the apparatus in gripping relation with the tree or pole while the lower arms thereof are positioned in retracted manner such as would occur following elevation of the main frame of the apparatus during climbing activity;

FIG. 3 is a side elevational view of the apparatus of FIGS. 1 and 2 with parts of the main frame structure broken away to illustrate the hydraulically energized cable drive system for elevation and retraction of the hydraulically driven telescoping mast and further showing the lower gripping arms in gripping position and the upper gripping arms in retracted position similar to the manner shown in FIG. 1;

FIG. 4 is a side elevational view of the apparatus of FIGS. 1–3, illustrating the position of the apparatus as shown in FIG. 2;

FIG. 5 is a sectional view of one of the gear boxes of the apparatus for achieving gripping and releasing activity of the gripping arms; and FIGS. 6 and 7 are schematic illustrations of electrical and hydraulic control circuitry for achieving control and operation of the climbing apparatus.

DETAILED DESCRIPTION OF THE PREFERRED EMBODIMENT

Referring now to the drawings and first to FIG. 1 tree climbing apparatus constructed in accordance with the present invention is illustrated generally at 10 and incorporates a main frame structure 12 in the form of an elongate housing. The main frame structure 12 is shown to be of rectangular cross-sectional configuration, but it is to be borne in mind that the main frame may take any other suitable form without departing from the spirit or scope hereof. A hydraulically driven telescoping mast 14 is disposed in telescoping relation with the main frame 12 and, as shown in FIG. 3 is operated for extension and retraction by means of an endless cable 16 which is secured to the hydraulically driven telescoping mast 14 by means of a cable clamp 18. The endless cable 16 is extended about an upper sheave 20 rotatably supported by the main frame and is also extended about the drive sheave 22 of a rotary hydraulic motor 24. The hydraulic motor 24 is a reversible motor and is capable of being energized under remote control by operating personnel for raising or lowering the hydraulically driven telescoping mast 14 relative to the main frame 12.

The hydraulically driven telescoping mast 14 is also of tubular form and may be of cylindrical configuration as shown or, in the alternative may take any other form. The apparatus 10 may incorporate one or more manually extendable secondary masts that may be employed as extensions to position one or more cable sheaves at a desired elevation above the hydraulically driven telescoping mast. As shown in the drawings, a lower manually extendable mast 22 is shown to be disposed in telescoping relation within the hydraulically driven telescoping mast 14 and is capable of being secured at any desired elevated position relative to the hydraulically driven telescoping mast by means of a locking pin 24. The pin 24 extends through the hydraulically driven telescoping mast 14 and is selectively receivable within any one of a number of vertically spaced pin receiving apertures formed in the mast 22. Thus, the mast 22 is selectively elevatable to any of a number of positions relative to the hydraulically driven telescoping mast. An upper manually extendable mast 26 is disposed in telescoping relation within the lower manually extendable mast 22 and is adjustably secured at any one of a number of elevated positions relative to the mast 22 by means of a locking pin 28. The locking pin 28 extends through apertures formed at the upper end of the mast 22 and is selectively receivable within any one of a number of vertically spaced mast positioning apertures formed in the upper mast 26.

The upper end of the upper manually adjustable mast 26 may be adapted to support any one of a number of supplemental attachments thus enabling the apparatus to serve a wide range of uses. For example, tree spraying apparatus may be releasably secured to the upper end of the mast 26 and by means of the manually telescoping masts 22 and 26 and the hyraulically driven telescoping mast 14 the tree spraying apparatus may be extended well upwardly into a tree for conducting efficient spraying operations. As shown in the drawings, the upper manual mast 26 is provided with a cable sheave 30 which receives a cable 32 that is controllably interconnected with an upper winch 34 which is driven by a motor 36. The motor 36 is preferably a rotary hydraulic motor for purposes of significant power and safety but it may take any other convenient form such as an electrically powered motor within the scope of this invention. The cable 32 is capable of being utilized for hoisting equipment from ground level to the working level of the apparatus and for accomplishing other heavy duty hoisting and lowering functions. For example, with the manual masts 22 and 26 extended, the cable 32 may be secured to a section of tree trunk well above the level of the hydraulically driven telescoping mast 14 for supporting the section of tree trunk as it is cut from the tree and then lowering the tree trunk section to ground level for safe handling and disposition by personnel at ground level. A lower winch motor 38 is secured to the lower portion of the main frame 12 and may also be energized either hydraulically or electrically. The winch motor 38 is a rotary motor which may be identical with the upper winch motor 34 and is employed to drive a winch 40 for power activation of a lower hoisting cable 42. If desired, the cable 42 may be extended about the cable sheave 30 in a manner similar to cable 32 to selectively provide alternative hoisting functions. The cables 32 and 42 may be employed alternatively or in combination depending upon the character of lifting that is intended. For simultaneous use of cables 32 and 42 the cable sheave 30 will be in the form of a pair of independently rotated sheaves that are supported by a pivot or bearing 44 of a sheave support device 46. The sheave support device, if desired, may be removably assembled in any desired manner to the upper end of the mast 26. This feature permits the cable sheave system to be replaced by supplemental apparatus such as a tree sprayer if desired.

The apparatus 10 is intended to provide climbing and descending functions relative to trees, poles, and other like structures. To accomplish this feature the apparatus is provided with upper and lower gripping mechanisms which are shown generally at 48 and 50 respectively. If desired each of the upper and lower gripping mechanisms may be of substantially identical form as shown in the drawings. The upper and lower gripping mechanisms as shown to be positioned in reversed orientation for efficient positioning of gripping arms. Such orientation, however, is not intended to limit the scope of this invention. Each gripping mechanism incorporates a gear box 52 which is secured to the upper end of the hydraulically driven telescoping mast 14 which is shown in greater detail in FIG. 5. The gear box 52 incorporates a pair of internal drive gears 54 and 56 of common diameter which are interconnected in driving and driven relation and are journalled for rotation within the gear box by means of shafts 58 and 60 received by journals or bearings 62. The shaft 60 is also a rotary input shaft extending from a drive coupling 66 into the gearbox and directly a driving the gear 56. Shaft 60 also functions as an output shaft. As the input shaft 64 is rotated this rotational movement is transmitted directly to the drive gears 54 and 56 and is thus transmitted to output sections 70 and 72 of the shafts 58 and 60. Upper and lower gripping arms 74 and 76 are secured in non-rotatable relation with respective output shafts 58 and 60 and are thus rotatable along with the shafts. The gear mechanism of the gear box develops counter-rotation of the arm drive shafts and thus counter-pivotal movement of the gripping arms 74 and 76. The gripping arms are enabled to be rotated by the arm driven shafts to a gripping position about the tree, pole or other object such as shown at the lower portion of the figure or a completely retracted position where the arms are directed away from the tree or pole such as shown at the upper portion of FIG. 1. The output shaft sections 70 and 72 are of differing lengths thus allowing the gripping arms 74 and 76 to overlap to enable the apparatus to grip small objects.

An upper hydraulic actuator, 78 is secured to the hydraulically driven telescoping mast 14 and has a rotatable output shaft 80 extending therefrom which is connected to the input shaft 60 of the gearbox 52 by means of a drive coupling 66. The hydraulic actuator 78 is capable of being controlled from a remote location for operation of the gripping arms 74 and 76.

The lower gripping mechanism 50 incorporates a gear box 82 which may be substantially identical with gear box 52 thus having a pair of output shafts that support and induce rotation to a pair of lower gripping arms 84 and 86. The gear box 82 and a hydraulic actuator 88 are fixed in spaced relation to the main frame 12 with a drive coupling 90 interconnecting the output shaft 92 of the hydraulic acutator to the input shaft 94 of the gear box.

Although the upper and lower gripping mechanisms are selectively operable for climbing and descending operations, it should be borne in mind that the hydraulic system of the gripping mechanism is designed to prevent the apparatus from inadvertently falling from the tree or pole during climbing and descending operations. The upper and lower gripping mechanisms are interconnected hydraulically in such manner that least one of the upper or lower gripping systems will always be disposed in gripping relation with the tree or pole when the apparatus is at elevation. Only at ground level and through appropriate manipulation of an override switch 96 will it be possible to simultaneously actuate both the upper and lower gripping mechanisms to the release positions thereof. The override switch 96 is fixed to the main frame 12 at a position where it can not be inadvertently actuated during use of the apparatus. By locating the override switch on the main frame the override switch can be manually operated by personnel at ground level only when the main frame 12 is at ground level. Thus, operating personnel can not inadvertently actuate the override switch and release both of the upper and lower gripping mechanisms while the tree climbing apparatus is at elevation. The override switch is actuated only at ground level to release both the upper and lower gripping mechanisms for its assembly or disassembly from the tree or pole.

To facilitate retention of either the hydraulically driven telescoping mast 14 or the main frame 12 in assembly with a tree or pole while the opposite gripping mechanism is released an upper wedging member 98 is secured to the hydraulically driven telescoping mast 14 and is positioned below the level of the gripping arms 74 and 76 of the upper gripping mechanism. When the upper gripping arms are in gripping relation with the tree or pole a wedging action is developed between the gripping arms and the wedging member thus insuring positive retention of the hydraulically driven telescoping mast in assembly with the tree or pole. Although the gripping arms themselves have sufficient structural integrity and force to support the entire apparatus relative to the tree or pole, the wedging member provides further assurance by developing a wedging action that enhances the retention capability of the gripping arms. Likewise, a similar wedging member 100 is fixed to the main frame 12 below the level of the gripping arms 84 and 86 of the lower gripping mechanism and establishes a wedging angle 102 as shown in broken lines that causes a wedging action to be developed between the main frame and the tree or pole to which the main frame is secured by the gripping arms. To further assist in guiding the relation of the main frame 12 with respect to the tree or pole upper and lower roller elements 104 and 106 are secured to the main frame and engage the tree or pole when the main frame is in properly oriented position relative thereto.

For hydraulic actuation of the upper and lower gripping mechanisms 48 and 50 a hydraulic power unit 108 is fixed to the main frame 12 and incorporates an electric motor 110 as its power supply. A power cable 112 and control cable 113 are provided. The power cable extends to a source of electrical current at ground level. The control cable extends from the hydraulic power unit to a push button station 114. The power and control cable is of sufficient length that the push button station 114 may be located a substantial distance from the climbing apparatus. For example, the push button station 114 may be handled by personnel at ground level while the climbing apparatus is located at significant elevation, for example 50 feet or so, above ground level.

The hydraulic power unit has its output hydraulically coupled with the upper and lower gripping mechanisms by means of hydraulic valve units 122 and 124 respectively. The hydraulic valve units also control selective activation of the various hydraulic motors of the hydraulically driven telescoping mast winch and the upper and lower winches of the main frame when selectively controlled by the push button station.

Although the telescoping hydraulically driven telescoping mast 14 permits the climbing apparatus to vertically traverse a tree or pole, in some cases, it is desirable that the apparatus have the capability of traversing laterally or "walking" around a tree or pole. This feature is accomplished by a plurality of "right-to-left" cylinders which extend from the main frame and hydraulically driven telescoping mast. As shown in the drawings, the main frame 12 incorporates upper and lower pairs 126 and 128 of lateral traversing cylinders which are in the form of linear hydraulic motors having fluid energized elements that are capable of establishing engagement with the tree or pole. Likewise, the upper portion of the hyraulically driven telescoping mast 14 is provided with a pair of lateral traversing cylinders 130 for the same purpose. These lateral traversing cylinders are hydraulically interconnected with the hydraulic valve unit 122 or with both the upper and lower hydraulic valve units as desired for selective operation of the lateral traversing control cylinders. These cylinders are sequentially activated while the upper and lower gripping mechanisms are selectively activated for gripping or releasing the apparatus in respect to the tree or pole. The apparatus can thus be walked around a tree or pole by appropriate manipulation of the push button stations.

Upward and downward movement of the hydraulically driven telescoping mast 14 by the hydraulic motor 24 and its endless drive cable is controlled in part by means of upper and lower limit switches 132 and 134 which are fixed in spaced relation on the main frame 12. The cable clamp 18 or any other structure supported by the cable will engage either of these limit switches at the respective upper and lower extremities of its travel, thus causing the limit switches to automatically deenergize the hydraulic circuit of the drive motor 24 when the hydraulically driven telescoping mast 14 has been raised or lowered to its maximum extent.

In addition to providing the apparatus with hydraulic safety features to prevent both the upper and lower gripping apparatus from simultaneously releasing while the apparatus is at elevation, the apparatus is also provided with mechanical safety features to further insure the safety of personnel utilizing the apparatus. Upper and lower pairs of tie down flanges 136 and 138 extend from both sides of the main frame 12. A pair of safety belts 140 and 142 extend from the respective tie down flanges and are capable of being secured in encircling relation about the tree or pole when the apparatus is located at the desired working elevation.

Referring now to FIG. 6 the electrical circuitry for the gripping arm control, override and warning circuits are shown schematically generally at 150. The arm control circuit incorporates an upper arm close switch 152 for controlling energization of a valve control coil 154 of a four-way hydraulic valve that controls the flow of hydraulic fluid from the hydraulic power unit to the hydraulic actuator for the upper gripping arm actuator system 48. The circuitry incorporates a switch 156 which controls opening of the lower arms 166. The switch 156 controls energization of an opening coil 158 for shifting the four way hydraulic valve for the lower gripping arms to an open position to thus achieve opening of the lower arms. The arm control circuit also includes a switch 160 which controls energization of the closing coil 162 of a four-way valve for controlling the hydraulic actuator of the lower gripping arm system 150. A switch 164 is also provided in the circuitry for controlling energization of the opening coil 166 of the four-way valve for the upper arms.

To prevent the upper or lower gripping arm systems 48 and 50 from being simultaneously opened, except upon closing of an override switch, the circuitry incorporates pressure activated switches 168 and 170, a lower open switch 172 and an upper open switch 174. An override circuit 176 forms a power override switch and incorporates a normally open override switch 178 which is controlled by the override switch button 96 also shown in FIG. 4. With the override switch 178 open it is not possible for the upper and lower gripping arms of the apparatus to be simultaneously opened. The circuitry also includes a switch 180 having its switch lever operated responsive to the position of the lower gear box and a similar switch 182 having its lever operated responsive to the position of the upper gear box. These switches control illumination of a safe indicator light 184 coupled with the circuitry. A warning indicator light 186 is coupled in parallel with hydraulic fluid pressure switches 172 and 174 and with the override switch 178. The warning light becomes illuminated either when the hydraulic pressure switches 172 and 174 are simultaneously closed or when the override switch 178 is closed. If the hydraulic system for either the upper of lower gripping arms does not become properly pressured for any reason a warning light will be illuminated.

Referring now to FIG. 7 the electrical and hydraulic systems for controlling the upper and lower winch motors and the mast drive motor are shown in schematic assembly with the hydraulic power unit and its accumulator. The hydraulic power unit 108 is shown to incorporate a hydraulic reservoir and manifold 188 having interconnected therewith hydraulic supply lines 190 and 192 which extend to the respective hydraulic actuators for the upper gripping arms and lower gripping arms respectively. Hydraulic winch circuits 194 and 196 also extend from the manifold and are coupled respectively with the four-way hydraulic control valves 198 and 200 of the upper and lower hydraulic winch motors 36 and 38 respectively. From the manifold also extends a hydraulic mast drive supply circuit 202 which is coupled with the four-way control valve 204 of the hydraulic mast drive motor 24 the four-way hydraulic valves 198 and 200 of the upper and lower winch motors are activated by appropriate closure of electrical up and down switches. As shown the opposed valve controlling coils 206 and 208 are selectively activated upon respective closure of switches 210 and 212 of the push button station 114. Likewise, the valve control coils 214 and 216 of the four-way hydraulic valve 200 are controlled respectively by closure of push button activated switches 218 and 220. For controlling the position of the four-way hydraulic valve 204 of the hydraulic mast drive motor 24 the control coils 222 and 224 are energized upon respective closure of push button control switches 226 and 228.

OPERATION

After movement of the apparatus 10 to the site of a tree, pole or other structure to be vertically traversed the apparatus will be positioned substantially vertically with its lower end in contact with the ground and with the rollers 104 and 106 in engagement with the tree or pole. In this condition, both of the upper and lower gripping mechanisms 48 and 50 will be positioned with the gripping arms thereof retracted to an open position. It should be borne in mind that the upper and lower sets of gripping arms can be released only when the apparatus is located at ground level. The climbing unit is first positioned against a tree or other object and the upper arms are opened by pushing the proper button of the push button station. The override switch 96 is then pressed to cause the lower gripping arms to open. When the climbing unit is properly positioned the lower gripping arms will close automatically when the override switch button is released. The upper arms will remain open unless the upper arm "close" button of the push button station is depressed. The operator will then manipulate the remote the remove push button station 114 causing energization of the rotary hydraulic motor 24 thus driving the endless cable 16 thus causing the cable clamp to extend the hydraulically driven telescoping mast 14 upwardly. When the cable clamp or any other suitable device supported by the cable comes into contact with the upper limit switch 132, the drive motor 24 will be deenergized thus stopping vertical movement of the hydraulically driven telescoping mast. The operator then manipulates the push button station to the climbing mode causing the upper gripping arms to pivot to the gripping position shown in FIG. 2. Hydraulic actuator 78, like the hydraulic actuator 88 incorporates a pressure switch in its circuitry that is activated only at a predetermined hydraulic pressure, for example 3,000 psi. Only when the pressure switch of the hydraulic actuator 78 is energized at the preselected hydraulic pressure will the lower hydraulic actuator 88 be permitted to move the gear train of the gear box 82 for opening of the lower gripping arms 84 and 86. The internal pressure switch of the lower hydraulic actuator 88 will permit movement of the upper hydraulic actuator to a position opening the gripping arms 74 and 76 only when a predetermined hydraulic pressure (for example 3,000 psi) is reached. At the predetermined pressures of the pressure switches of each of the hydraulic actuators 78 and 88 the respective gripping arms controlled thereby will be in positive gripping relation with respect to the tree or pole. This is a safety feature that effectively assures that the apparatus can not be inadvertently released to fall from the tree or pole.

During elevation of the hydraulically driven telescoping mast 14 it is not necessary that the hydraulically driven telescoping mast be elevated to its full extent. The limit switches 132 and 134 are provided simply to prevent upward or downward overtravel of the hydraulically driven telescoping mast and its operating system. After the hydraulically driven telescoping mast has been appopriately elevated such as shown in FIGS. 1 and 3 the push button station 114 will again be manipulated to close the upper arms 74 and 76 and then open the lower arms to release the main frame 12 from the tree or pole while the upper arms remain in gripping relation. Thereafter, the hydraulic drive motor 24 will again be energized to retract the hydraulically driven telescoping mast 14 relative to the main frame. Since in this condition the main frame will merely be supported by the hydraulically driven telescoping mast, this retraction movement will cause the main frame to be elevated relative to the tree or pole. Upward movement of the main frame may be discontinued at any point or it may continue until the cable clamp comes into contact with the lower limit switch 134 whereupon, the hydraulic motor is automatically deenergized. The push button station will then be manipulated to activate the lower hydraulic actuator 88 to thus close the lower gripping arms. The upper gripping arms may then be released and opened assuming that the pressure switch of the lower hydraulic actuator has reached sufficient hydraulic pressure for establishing proper gripping relation with the tree or pole and thus activating its pressure switch so that the hydraulic lock-out mechanism will permit release of the opposite gripping arms. The sequence is then repeated sufficient times to cause the apparatus to climb to the desired elevation.

During climbing if limbs or other objects must be avoided, the push button station 114 is appropriately manipulated to selectively activate the side mounted lateral traversing direction control cylinders 126, 128 and 130 to cause the apparatus to rotate clockwise or counter-clockwise relative to the tree or pole so as to avoid the obstruction as the climbing sequence continues.

After the apparatus has climbed to a desired working elevation, the power and push button station 114 is appropriately manipulated to cause locking of both the upper and lower sets of gripping arms. In this condition both of the sets of gripping arms wil cooperate with the respective wedging members 98 and 100 to develop wedging activity of both the main frame and hydraulically driven telescoping mast relative to the tree or pole. Obviously, during climbing each set of arms will establish a wedging action with the tree or pole while the opposite set of gripping arms are opened or retracted.

For tree surgery operations, so as not to damage the trunk of a tree the gripping arms may be provided with resilient cushioning sleeves. Due to the wedging activity between the gripping arms and the wedging members 98 and 100 positive retention of the main frame and hydraulically driven telescoping mast with respect to the tree or pole may be established without causing the gripping arms to bite into or otherwise damage a tree. For delicate trees, however, it may be necessary to incorporate cushioned gripping arm covers to prevent damage to the tree being climbed.

After the upper and lower gripping arms have been secured to the tree or pole at working elevation the upper and lower safety belts 140 and 142 will be secured so that the apparatus is mechanically as well as hydraulically secured to the structure being climbed.

The push button station 114 is then further manipulated to activate the lower winch motor 38 to thus lower the personnel hoisting cable to ground level. After the operator has confirmed the integrity of the clamping action of both the upper and lower sets of gripping arms about the tree or pole the operator then will then attach the hoisting cable to any tools or equipment to be raised to operating level or any object such as a tree limb to be lowered. The operator will then activate the winch as appropriate for the desired activity. After the apparatus has climbed to the desired position or level the operator will appropriately secure the safety belts 140 and 142 about the tree or pole to thus assure that the apparatus is retained mechanically as well as hydraulically in firm and secure relation with the tree or pole. It should be borne in mind that safety cables may be employed instead of safety belts and may be appropriately attached to the laterally extending pairs of tie down plates 136 and 138.

If the operator is in the performance of tree surgery, such operations may be conducted safely.

If the tree is to be removed, the manually extendable masts 22 and 26 may be appropriately extended and secured by means of the locking pins 22 and 24 to thus position the cable sheave 30 at a desired elevation. The cable from the upper winch 36 is then appropriately moved through manipulation of either of the push button stations and is attached to an upper portion of the tree section to be removed. This cable will support the tree section as it is cut from the tree. The push button stations may then appropriately manipulated to cause the upper winch to lower the cut tree section to ground level where it may be safely handled by personnel at ground level. For cutting and removing a next lower section of the tree, with the safety belts 140 and 142 released, the push button stations may be manipulated by the operator at a remote location, causing the apparatus to climb down the tree to an appropriate position for supporting and cutting the next section of tree to be removed. These activites are continued sequentially until the main frame 12 reaches ground level.

In many cases lower limbs are to be removed below the apparatus. In this case, the operator will employ the cable of the lower winch 38 which will be secured to the personnel safety harness. The push button station will be manipulated to activate the winch and lower the operator to the desired elevation to remove the desired limbs. When such work is being conducted the cable of the upper winch will be employed to secure the limbs to be cut. After the limbs are cut from the tree they may be safely lowered to ground level for handling by ground personnel upon appropriate manipulation of the respective power and push button stations.

While the foregoing is directed to the preferred embodiment, the scope is determined by the claims which follow.

What is claimed is:

1. Apparatus for climbing objects such as trees, poles and the like, comprising:

(a) a main frame;

(b) a hydraulically driven telescoping mast being connected in telescoping relation with said main frame;

(c) power energized telescoping means establishing driving relation between said main frame and hydraulically driven telescoping mast for selectively extending and retracting said hydraulically driven telescoping mast relative to said main frame;

(d) first gripping means being supported by hydraulically driven telescoping mast and incorporating a first pair of pivotal gripping arms for establishing gripping relation with said object;

(e) second gripping means being supported by said main frame and incorporating a second pair of pivotal gripping arms for establishing gripping relation with said object;

(f) first and second arm drive means interconnected in driving relation respectively with said first and second gripping means;

(g) power energized winch means being supported by at least one of said main frame and hydraulically driven telescoping mast and being operable for lifting or lowering objects relative to said apparatus;

(h) power and control means being supported by said main frame and having power interconnection with said power energized telescoping means, said first and second gripping means, said first and second arm drive means and said winch means, said power and control means having remote push button station means being interconnected in controlling relation with said power and control means and being operable by personnel from locations remote to said power and control means for operation of said apparatus; and (i) safety interlock means being interconnected with said first and second gripping means and normally ensuring that at least one of said first and second gripping means is in gripping engagement with said object, said safety interlock means having manual lockout means accessible for manual operation when said main frame is at ground level relative to said object.

2. Apparatus as recited in claim 1 wherein said power energized telescoping means comprises (a) a rotary motor supported by said main frame and having drive sheave means rotated thereby;

(b) an idle sheave means supported for rotation adjacent the opposite extremity of said main frame; and (c) an endless cable being received by said drive sheave means and said idler sheave means and being coupled in driving relation with said hydraulically driven telescoping mast.

3. Apparatus as recited in claim 2 wherein said power and control means incorporates a pair of limit switches supported in spaced relation by said main frame, said limit switches being actuated as said hydraulically driven telescoping mast reaches respective limits of its upward and downward travel to thereby deactivate said drive motor means.

4. Apparatus as recited in claim 3, wherein said rotary drive motor means is in the form of a rotary hydraulic motor controlled by said power and control means responsive to manual actuation of said remote push button station means.

5. Apparatus as recited in claim 1, wherein each of said first and second gripping means comprises:

(a) rotary actuator means being interconnected respectively with said hydraulically driven telescoping mast and main frame, each having a rotary output shaft;

(b) gear means being interconnected in driving relation with said rotary actuator means and having a pair of counter-rotating output shafts driven by said gear means; and (c) a pair of gripping arms extending from respective ones of said output shafts and being rotatable by said output shafts between gripping and retracted positions relative to said object.

6. Apparatus as recited in claim 5 wherein each of said arms is of generally curved configuration and is adapted to extend at least partially around said object.

7. Apparatus as recited in claim 5 wherein each of said rotary actuator means is in the form of a hydraulic actuator having said rotary output shaft extending therefrom.

8. Apparatus as recited in claim 7, wherein each of said hydraulic actuators incorporates a pressure activated control circuit means which is operative to deenergize the respective hydraulic actuator at the gripping positions of said gripping arms and to selectively condition the opposite hydraulic actuator for energization to thus insure that at least one of said pairs of gripping arms remains in gripping relation with said object to prevent inadvertent falling of the climbing apparatus.

9. Apparatus as recited in claim 8 including override control means located on said main frame and being controllably coupled with said pressure activated control circuit means and thus being normally accessible for manual activation when said main frame is located at ground level.

10. Apparatus as recited in claim 1 wherein said power and control means comprises:

(a) an electrically energized hydraulic power unit being supported by said main frame and having hydraulic output and return lines extending therefrom;

(b) hydraulic valve means being supported by said main frame and being operatively connected to said output and return lines and to said first and second arm drive means; and (c) remote push button station means having controlling connection with said hydraulic power unit and with said hydraulic valve means for thus selectively controlling energization of said first and second arm drive means and said power energized telescoping means for operation of said apparatus.

11. Apparatus as recited in claim 10 including:

(a) winch means being supported by said main frame and having cable means for accomplished lifting and lowering operations; and (b) motor means for operation of said winch means.

12. Apparatus as recited in claim 11 wherein said motor means of said winch means is in the form of rotary hydraulic motor means.

13. Apparatus as recited in claim 10 wherein said remote push button station means may be operated by personnel at ground level and at elevation relative to said object, said remote push button station means including electrical circuitry for controlling all aspects of said apparatus.

14. Apparatus as recited in claim 1, including:

(a) manual mast means being received in telescoping relation with said hydraulically driven telescoping mast and being extendable to selected levels above said hydraulically driven telescoping mast; and (b) cable sheave means being supported by said manual mast means and receiving cables of said winch means.

15. Apparatus as recited in claim 14 wherein said manual mast means incorporates;

(a) upper and lower telescoping masts, said upper manual mast being received within said lower manual mast, said lower manual mast being received in telescoping relation within said hydraulically driven telescoping mast;

(b) locking pin means being receivable by said hydraulically driven telescoping mast and by said lower manual mast for selectively securing said upper and lower manual masts at selected telescoping positions thereof.

16. Apparatus as recited in claim 1, wherein:

(a) said first and second gripping means each being a pair of gripping arms rotated in counter-rotating relation by respective ones of said first and second arm drive means; and (b) wedging means being disposed below the respective levels of said gripping arms of said first and second gripping means and extending from said hydraulically driven telescoping mast and said main frame respectively for engagement with said object, said wedging means upon closing of said gripping arms to said gripping position developing a wedging activity for support of said hydraulically driven telescoping mast and said main frame relative to said object.

17. Apparatus as recited in claim 1, including:

lateral traversing means being supported by said main frame and said hydraulically driven telescoping mast and positioned for engagement with said object, said lateral traversing means being operated by said hydraulic power unit responsive to control by said remote console means.

18. Apparatus as recited in claim 17 wherein said lateral transversing means comprises:

(a) a plurality of hydraulic cylinders being respectively connected to said main frame and said hydraulically driven telescoping mast, said linear hydraulic cylinders incorporating movable means for engaging said object and applying sufficient force to impart lateral traversing movement of said apparatus relative to said object.

19. Apparatus as recited in claim 1, wherein said first and second gripping means are selectively positionable in retracted manner to enable said apparatus to climb between lateral obstructions such as tree limbs.

* * * * *